US009302811B2

(12) United States Patent
Orgeldinger

(10) Patent No.: US 9,302,811 B2
(45) Date of Patent: Apr. 5, 2016

(54) TRANSPORT CONTAINER SYSTEM WITH STACKABLE CRATE HAVING MOVABLE ATTACHMENT ELEMENTS FOR HEIGHT ADJUSTMENT

(75) Inventor: Wolfgang Orgeldinger, Munich (DE)

(73) Assignee: IFCO SYSTEMS GMBH, Pullach (DE)

( * ) Notice: Subject to any disclaimer, the term of this patent is extended or adjusted under 35 U.S.C. 154(b) by 764 days.

(21) Appl. No.: 12/984,449

(22) Filed: Jan. 4, 2011

(65) Prior Publication Data

US 2011/0094916 A1 Apr. 28, 2011

Related U.S. Application Data

(62) Division of application No. 11/983,628, filed on Nov. 9, 2007, now Pat. No. 7,886,926.

(30) Foreign Application Priority Data

Nov. 9, 2006 (DE) ..... 10 2006 052 877

(51) Int. Cl.
*B65D 21/00* (2006.01)
*B65D 21/08* (2006.01)

(52) U.S. Cl.
CPC ..... *B65D 21/083* (2013.01)

(58) Field of Classification Search
CPC ..... B65D 1/243; B65D 71/70; B65D 85/305; B65D 21/0212; B65D 21/06; B65D 21/066; B65D 21/068; B65D 21/08; B65D 21/083
USPC ..... 206/507, 509, 512, 517; 220/1.5, 4.03, 220/4.28, 6, 7, 666
See application file for complete search history.

(56) References Cited

U.S. PATENT DOCUMENTS

| | | | | | |
|---|---|---|---|---|---|
| 3,130,850 | A | * | 4/1964 | Mynatt et al. | 220/6 |
| 3,672,530 | A | * | 6/1972 | Bridenstine et al. | 220/4.03 |
| 4,014,458 | A | | 3/1977 | Berges | |
| 4,044,910 | A | * | 8/1977 | Box | 220/7 |
| 4,062,467 | A | * | 12/1977 | Friedrich | 220/7 |
| 4,674,647 | A | | 6/1987 | Gyenge et al. | |
| 4,714,169 | A | * | 12/1987 | Keenan et al. | 220/8 |
| 4,723,679 | A | | 2/1988 | Sinchok et al. | |
| 4,735,330 | A | | 4/1988 | Hoss | |
| 4,775,068 | A | * | 10/1988 | Reiland et al. | 220/6 |

(Continued)

FOREIGN PATENT DOCUMENTS

| | | |
|---|---|---|
| DE | 103 26 574 | 1/2005 |
| NL | 9300986 | 1/1995 |

*Primary Examiner* — Anthony Stashick
*Assistant Examiner* — Robert Poon
(74) *Attorney, Agent, or Firm* — Michael A. Glenn; Perkins Coie LLP

(57) ABSTRACT

A transport container system includes a stackable crate having a bottom element and four side wall elements which are of a dimensionally and pressure stable structure. Each of the side wall elements has a foldable attachment element connected to it. When folded up, the attachment elements of the four side wall elements will form an attachment which will increase the volumetric capacity of the crates. The attachment elements will each bear on an upper side of the respective side wall element and be retained in the folded-up position by guides provided on the side wall elements. When folded down, the respective attachment elements can be integrated into the respective side wall element in such a manner that the attachment elements at least will not protrude substantially over the thickness of the side wall elements.

9 Claims, 4 Drawing Sheets

(56) References Cited

U.S. PATENT DOCUMENTS

| | | | | |
|---|---|---|---|---|
| 4,917,255 | A | 4/1990 | Foy et al. | |
| 4,974,737 | A | 12/1990 | Miller | |
| 4,998,967 | A * | 3/1991 | Box | 119/489 |
| 5,114,037 | A | 5/1992 | Hillis et al. | |
| 5,161,709 | A | 11/1992 | Oestreich, Jr. | |
| 5,199,592 | A * | 4/1993 | Reiland et al. | 220/817 |
| 5,289,935 | A | 3/1994 | Hillis et al. | |
| 5,934,486 | A * | 8/1999 | Jarvis et al. | 211/41.8 |
| 5,938,059 | A * | 8/1999 | Luburic | 220/6 |
| 6,015,056 | A | 1/2000 | Overholt et al. | |
| 6,098,827 | A | 8/2000 | Overholt et al. | |
| D452,614 | S * | 1/2002 | Overholt | D3/305 |
| 6,409,041 | B1 * | 6/2002 | Overholt et al. | 220/669 |
| 6,601,724 | B1 | 8/2003 | Koefelda et al. | |
| 6,631,822 | B1 * | 10/2003 | Overholt | 220/7 |
| 6,634,510 | B2 * | 10/2003 | Larson et al. | 211/41.8 |
| 6,776,300 | B2 | 8/2004 | Walsh et al. | |
| 7,063,223 | B2 | 6/2006 | Iwahara et al. | |
| 7,128,231 | B2 * | 10/2006 | Overholt | 220/4.28 |
| 7,264,122 | B2 * | 9/2007 | Koefelda et al. | 206/600 |
| 7,353,962 | B2 | 4/2008 | Parnall et al. | |
| 7,556,166 | B2 | 7/2009 | Parnall et al. | |
| 7,641,066 | B2 * | 1/2010 | Baltz | 220/7 |
| 7,708,160 | B2 | 5/2010 | Booth et al. | |
| 8,047,369 | B2 * | 11/2011 | Stahl | 206/506 |
| 2002/0070215 | A1 * | 6/2002 | Walsh et al. | 220/6 |
| 2002/0092850 | A1 | 7/2002 | Iwahara et al. | |
| 2004/0020821 | A1 * | 2/2004 | Koefelda et al. | 206/600 |
| 2004/0099662 | A1 * | 5/2004 | Overholt | 220/7 |
| 2004/0222222 | A1 | 11/2004 | Parnall et al. | |
| 2006/0138130 | A1 | 6/2006 | Orgeldinger | |
| 2006/0231555 | A1 * | 10/2006 | Smyers et al. | 220/6 |
| 2007/0158345 | A1 * | 7/2007 | Booth et al. | 220/6 |
| 2008/0179322 | A1 * | 7/2008 | Parnall et al. | 220/6 |

* cited by examiner

TRANSPORT CONTAINER SYSTEM WITH STACKABLE CRATE HAVING MOVABLE ATTACHMENT ELEMENTS FOR HEIGHT ADJUSTMENT

CROSS-REFERENCE TO RELATED APPLICATIONS

This application is a Divisional of U.S. patent application Ser. No. 11/983,628, filed Nov. 9, 2007, which was issued on Feb. 15, 2011 as U.S. Pat. No. 7,886,926, which claims priority to German Patent Application Serial No. 10 2006 052 877.8, filed Nov. 9, 2006, which are each incorporated herein in its entirety by this reference thereto.

BACKGROUND

The present invention relates to a transport container system, in particular for bulk goods, comprising a stackable transport container, preferably a crate, which may be of the collapsible or non-collapsible type. This type of crate is known and used in particular for transporting bulk goods such as fruit and vegetables. The term bulk goods as used in the context of the present invention shall denote a unit of goods to be transported which consists of discrete pieces of a minimum size between 0.5 cm and 1.0 cm.

The non-collapsible and collapsible containers of the prior art, in particular crates, for transporting fruit and vegetables are made of cardboard, wood or plastic. The special feature of collapsible transport containers is that their side walls can be moved down onto the inner bottom surface of the transport containers, which results in a volume reduction of the empty transport container. When folding the container up again, the side wall elements will be arranged perpendicular (at 90°) to the inner bottom surface and will be detachably connected to each other through various means. While the bottom surface of the transport containers is of a defined size, there are containers which have side walls of different heights, in which two or four side wall elements have the same height, to allow different transport volumes to be obtained. Furthermore, on their upper side facing away from the bottom surface, the side wall elements are provided with a profile or a means to make them stackable. In order to increase the stability of the transport containers, especially as regards their stackability, these are preferably reinforced at their corners. The maximum volumetric capacity of the prior art transport containers is defined by the size of the bottom surface and the height of the side wall elements. For a higher volumetric capacity, the transport containers must have different and higher side wall elements. This does not allow for a fast adjustment of their volumetric capacity to changing consumer demands.

The sizes of certain kinds of fruit and vegetables wilt vary from one harvest season to the next depending on different factors, for example during their growth period. The sizes of fruit or vegetables to be packaged are specified in EC regulations. The varying sizes of the bulk goods to be transported are thus a known problem in the transport of bulk goods such as fruit and vegetables which makes optimal filling of transport containers difficult. In order to cope with the varying demands posed by the bulk goods, the transport containers, in particular crates, are machine-produced in certain sizes which are also determined by the production line and/or by the production parameters selected. This makes it impossible to rapidly change the size—and thus the volumetric capacity—of a vast number of transport containers so as to ensure optimal filling of the containers based on the size of the bulk goods without major logistic transport problems or a time-consuming change-over of production lines and resulting high costs.

The above mentioned problem will crop up with the prior art transport containers especially when relatively easy-to-produce cardboard packaging for transporting bulk goods such as fruit and vegetables is replaced with returnable containers made of plastic or a material similarly suitable for this purpose which are friendlier to the environment but also more complex and costly in production. An ideal adjustment of the transport containers to the size of the bulk goods to be transported will prove especially complex and difficult in the case of the prior art returnable plastic containers. For maximum utilization of the means of transport, the transport containers can be stacked which allows a vast number of them to be transported in large containers, on loading areas, in goods wagons or similar means of transport. The bulk goods thus transported must not protrude above the upper edge of the transport containers since this would interfere with the stacking of the transport containers or otherwise damage the bulk goods. As a consequence, the volumetric capacity of the prior art transport containers cannot be fully utilized in many instances.

The applicant's returnable transport containers, the technical term for which is "round trip containers", come in at least ten different designs which differ in the height of their side wall elements. The heights of the side wall elements range between 8 cm and 28 cm, with heights of 8 cm, 10 cm, 13 cm, 15 cm, 16 cm, 18 cm, 20 cm and 23 cm being preferably used. The bases of these transport containers are preferably rectangular in shape and their external measurements are preferably 600 mm×400 mm. This is approximately an integer fraction of the size of the surface area of standard Euro and U.S. pallets. However, transport containers of a different size, for example 400 mm×300 mm, are also used.

NL 93 00 986 discloses a container having at least one bottom element and one wall element. Provided on the wall element are projections which can be made to engage in recesses provided in the bottom element to connect the wall element to the bottom element. It is furthermore disclosed in NL 93 00 986 how a circumferential one-piece frame may be placed on a container to enlarge its volume which is delimited by the wall element and the bottom element.

DE 103 26 574 A1 discloses a transport container, in particular for transporting bulk goods such as fruit and vegetables, comprising a collapsible or non-collapsible stackable crate having a bottom element as well as four side wall elements of a pressure- and/or load-resistant structure. For increasing the volumetric capacity of the transport container, an attachment unit is provided whose shape corresponds to that of the side wall elements and which can be placed on top of the side wall elements of the crate. The attachment unit has been designed to form a closed frame which can be folded at its diagonal corners. The foldable attachment unit is preferably made of cardboard and will be disposed of after use. The side wall elements of the crate and the side wall elements of the attachment unit can be snapped into mutual engagement when the attachment unit is put on top of the crate, and can be released again when the attachment unit is taken off.

US 2004/0222222 A1 discloses a collapsible transport container which is adjustable in height. The transport container has a base which also constitutes the bottom surface of the transport container. The transport container furthermore includes a pair of long side walls extending opposite each other and a pair of short side walls extending opposite each other, with extension walls being provided on each of the side walls. Together with the extension walls, the short and the long side walls can be folded down onto the base to reduce the volume of the empty transport container to a minimum. The short side walls and the long side walls can be arranged so as to extend perpendicular to the bottom surface in which position they will then be locked with each other by means of locking elements provided on the short side walls. If required, long extension walls may be folded out from the long side walls and short extension walls may be folded out from the short side walls so as to form—in a first embodiment—upwards extensions each of the long and of the short side walls. Once folded out, the extension walls will be mutually locked, by means of additional locking elements disposed in the short extension walls, so as to form a frame.

The attachment unit can thus be taken off and disposed at the place of delivery. Once it has been emptied and cleaned, the reusable crate may for example be folded and stacked and will then be ready for future use for which no attachment units, attachment units of a different height or the same attachment units but a different amount thereof may be required. In most cases, it therefore makes more sense to store the crates separately from the attachment units. This leads to various costs, on the one hand for producing the attachment units and on the other hand for storing crates and attachment units separately, with the increased expenditure being incurred both at the place where the crates are filled and at the place where they are made. Additional costs will also be incurred at the place where the crates with the attachment units are emptied, due to the disposal of the cardboard attachment units.

SUMMARY OF THE INVENTION

In view of this prior art, it is the object of the present invention to provide a crate having means for increasing its volumetric capacity, which means will only be used when required, and when not used will neither change the crate dimensions nor interfere during transport or use of the crate.

A transport container system according to the invention is characterized by a stackable transport container, in particular a crate, which consists of a bottom element and four side wall elements of a dimensionally stable and pressure resistant structure. The stackable crate is preferably of a collapsible, i.e. folding, type but may also be non-collapsible.

The transport container system of the present invention furthermore comprises an attachment element for each side wall element such that the four attachment elements of the respective side wall elements taken together will allow an increase of the volumetric capacity of the crate. To this end, the attachment elements are foldably or pivotably and/or slidably connected to the respective side wall elements so as to enable the attachment elements to be brought into an attached or erected position, if required, in which they rest or are supported on the top or an upper contact surface of the respective side wall element, for example. The side wall elements furthermore include guides for maintaining the attachment elements in the folded up or erected position. In the folded down or integrated position, the attachment elements can be accommodated in or introduced into the side wall element so as to prevent the attachment elements from protruding substantially over the thickness or height of the side wall elements.

The fact that attachment elements are foldably or pivotably and/or slidably mounted and accommodated in the side wall elements allows a variable and optimal adjustment of the transport container to the bulk goods to be transported therein since the attachment elements may be folded up and down, or extended and retracted, or pivoted up and down as required. This eliminates logistics costs or additional transport costs for additional parts—as incurred in the prior art.

A particular advantage of the invention is obtained when the side wall elements of the stackable crate are likewise of the folding type. In this case, the side wall elements can be folded down from an upright position, in which the side wall elements are substantially perpendicular to the bottom element, into a horizontal position relative to the bottom element in which the side wall elements extend substantially in parallel to the bottom element. Preferably, the dimensions of the side wall elements and of the attachment elements have been chosen such that the attachment elements can be integrated into the side wall elements so as to prevent them from protruding or from protruding substantially over the dimensions of the side wall elements. As used herein, the term "not substantially" shall mean that, at the most, the attachment elements will protrude over the dimensions of the side wall elements only to such an extent that all side wall elements can be folded down essentially in parallel onto the bottom element so as not to interfere with an easy and compact stacking of the collapsed crates. This also requires the mechanisms needed for erecting and folding to be capable of being integrated into the side wall elements in such a manner that they will not protrude over the side wall elements in the direction of their thickness.

When the attachment elements are folded down, they must not or not substantially protrude over the thickness of the side wall elements in their upright position so as not to or not substantially increase the outer dimensions of the crate. The preferred outer dimensions of the crate are 600 mm×400 mm which is a quarter of the surface area of a standard Euro pallet. However, the invention can also be used with smaller crates, such as crates of a size of 400 mm×300 mm.

For stacking the crates, a special profile is provided at the top of the side wall elements which will support the corresponding circumferential regions on an underside of the bottom element and will thus ensure that the crates can be stacked without shifting. To enable the crates to be stacked without shifting even with raised or moved-up attachment elements, the top sides of the attachment elements have to match up with the profile on the underside of the bottom element in those areas where they contact the underside of the bottom element of a crate on top of them. In other words: Essentially the same profile is provided at the top of the attachment elements as at the top of the side wall elements or as the inverted profile of the circumferential edge on the underside of the bottom element.

To ensure that crates of this type can be stacked easily without shifting, the corner portions of adjacent side wall elements are preferably specially designed. To also guarantee safe stacking without shifting of the crates with the attachment elements in place, at least parts of these corner portions have to find a match in the attachment elements. For this purpose, however, it is not necessary for two adjacent attachment elements to contact each other in the corner areas or even to be connected to or locked with each other—even if this falls under the inventive concept. Even if it is possible to design the attachment elements such that they completely match the corner areas of the side wall elements, it will suffice for most cases to only replicate portions of these corner areas to ensure stability and prevent shifting of the crates, and to abstain from connecting the attachment elements in the corner areas.

To ensure stable and reliable stacking, however, the attachment elements must be fixed in their folded-up position. In this case, the attachment elements may directly bear on the top sides of the side wall elements, for example in the direction of gravity; and guiding in directions which run in a plane perpendicular to gravity can be accomplished through recesses provided in the side wall elements and/or by mounting the attachment elements on the side wall elements by means of joints. Preferably, the recesses in the side wall elements are designed such that no additional sliders are required for their production in an injection moulding process. For example, the attachment elements can be folded up by pivoting them upward by 180° such that, in its pivoted-up position in the direction of the pivoting movement, the attachment element will bear directly on a stop provided on the side wall element, and will be prevented from pivoting downward again by detent lugs which accommodate a nose or a guide rod of the attachment element. At the same time, mobility of the attachment element in the direction of the pivot axis will be prevented by suitably designed support walls, stops and recesses.

Furthermore, to ensure good stackability of the crates with the attachment elements folded up, it is obvious that the top sides of the attachment elements must extend in a common plane in parallel to the bottom element. In this context it is irrelevant whether the side wall elements are of the same height since this can be compensated by different heights of the attachment elements. Even if it is normally assumed that the top sides both of the side wall elements and of the attachment elements, i.e. the respective bearing surfaces for a bottom element of another crate placed atop the present crate, are each arranged in a common plane extending in parallel to the bottom element, the invention shall also encompass embodiments of transport containers in which the top sides or bearing surfaces both of the side wall elements and of the attachment elements do not each extend in a common surface in parallel to the bottom element. Thus a crate is conceivable in which only the shorter side walls, i.e. the front walls, have the function of supporting and guiding the crate placed on it. If a crate is used for example in which the height of the front walls is half of the length of the crate, and if this crate is folded such that opposing side wall elements, in a horizontal position thereof, will be in the same plane, i.e. the folded-down side wall elements will not overlap, then the maximum height of the long side wall elements will amount to half of the width of the crate and will thus be, in the case of a rectangular crate, lower than the front walls.

In order to compensate for the difference in height, attachment elements may be provided on the longitudinal side wall elements in this case. As with the crates whose side wall elements all have the same height, also the volumetric capacity of a crate of this kind can even be increased by using suitably adapted attachment elements.

It is irrelevant for the purposes of the present invention whether the attachment elements can be folded up, from a folded down position thereof, from an inner side facing the opening of the crate or from an outer side facing away from the opening of the crate. In either case, it must be ensured that—once the attachment elements have been folded up—they will be fixed in their folded-up positions such that the crates can be stacked safely, and that in the folded-down position, the outer dimensions of the bottom element will not be exceeded in the directions of its length and of its width.

The attachment elements may be made from the same material as the side wall elements or also from a different material. The same is true as far as colouring is concerned, with attachment elements of a different colour being well suited for applying a logo or other information for advertising purposes thereon.

In summary, it may be concluded that the present invention provides a flexible means for varying the volumetric capacity of a crate, in particular for transporting fruit and vegetables, in a fast and simple way. For this purpose, the invention provides attachment elements which—when folded down—are integrated into the side wall elements of a crate and—when folded up—will increase the volumetric capacity of a crate depending on the height of the attachment element, at the same time making the crates safely stackable. Use of attachment elements of different heights for one type of crate makes individually adapted solutions possible.

Use of likewise suitable pivoting or folding mechanisms or combinations of swivel or sliding joints will allow the attachment elements to be located at different height levels for example, which will in turn allow an additional, more flexible adjustment of the volumetric capacity of the container to the goods to be transported therein. The term "swivel-sliding joint" as used in the present invention shall denote a joint which allows both a rotation and a simultaneous or subsequent translation of the attachment element.

Furthermore, what matters for the practical implementation of the inventive principle is not the number of joints used for connecting the attachment element to the side wall elements but only that use of the attachment elements allows a variable adjustment of the volumetric capacity of the crates to the goods to be transported therein and that such adjustment is reversible and repeatable or variable, for which purpose the devices are undetachably connected to the crate.

Although the inventive principle preferably has the attachment elements undetachably connected to the crate or its side walls, this does not mean that they cannot be removed and reattached. Preferably, this may be effected through a suitable catch mechanism. This proves particularly advantageous for replacing a damaged attachment element.

The inventive attachment elements may be used both with crates whose side wall elements will overlap when folded down and with crates whose folded-down side wall elements will not overlap. Where the side wall elements do overlap when folded down, and irrespective of whether the attachment elements have been folded down or up, this will increase the stacking height of the empty collapsed crates, thus making them more difficult to stack. The transport container system of the present invention shall also encompass this type of crate.

The following is an exemplary description of some embodiments of the crate according to the invention in which reference is made to the drawings. Note that in the drawings, identical reference numerals are used for parts which have the same function. As will be clear to the skilled person, other embodiments also fall under the inventive concept.

DETAILED DESCRIPTION

Figure 1:
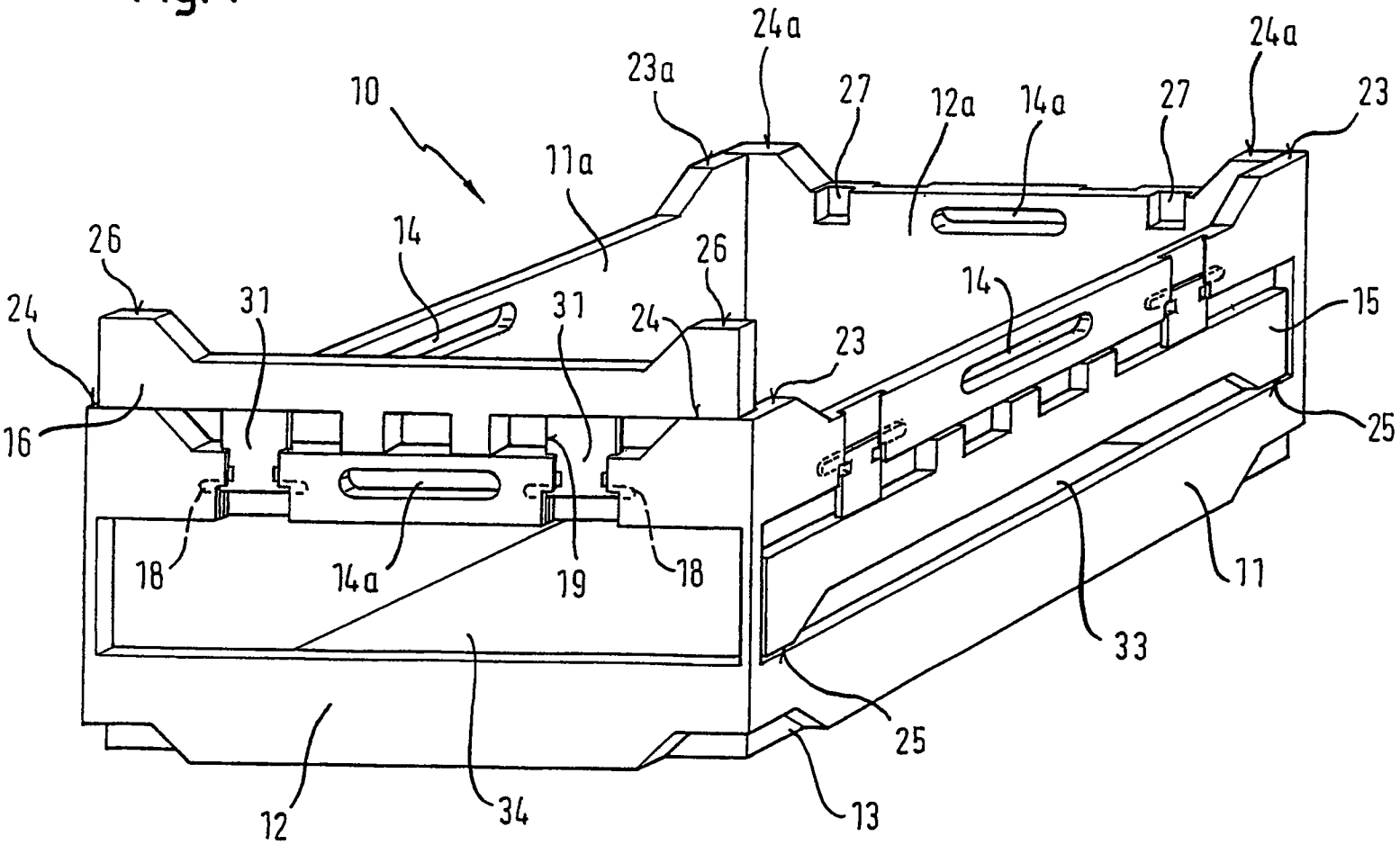
FIG. 1 is a schematic perspective view of an inventive crate having a folded-down attachment element on a longitudinal side thereof and a folded-up attachment element on a front side of the crate.

FIG. 1 is a perspective view of one possible embodiment of a transport container 10 according to the invention. The transport container 10 of FIG. 1 comprises a collapsible crate 10 having a bottom element 13 and attachment elements 15, 16, which are undetachably mounted on side wall elements 11, 11*a*, 12, 12*a*. As can be seen in FIG. 1, the attachment element 15 is integrated into a recess 33 and is substantially flush therewith in the direction of thickness, i.e. if at all, the attachment element 15 will only protrude slightly over the side wall element 11 in the direction of its thickness. Just as the attachment element 15 is accommodated in the side wall 11 of FIG. 1, the other attachment elements 15 and 16 can also be accommodated in their respective side walls 11*a*, 12 and 12*a*.

With the attachment elements 15 and 16 folded down and the side wall elements 11, 11*a*, 12 and 12*a* folded up, the upper bearing surfaces 23, 23*a*, 24 and 24*a* of the side wall elements 15 and 16 will serve as supports for a crate 10 placed thereon. Once the attachment elements 15 and 16 have been folded up, the upper bearing surfaces 25 and 26 of the attachment elements 15 and 16 will take the function of support surfaces for the bottom element 13 of another crate 10 which has been placed on top of the present crate 10.

When the attachment element 16 is folded up, as shown in FIG. 1, it will elongate its associated side wall in the direction of its height, and when the attachment elements 15 and 16 are folded up, they will increase the total height of the crate 10. In this situation, as viewed in the direction of the height of the side walls, the attachment elements 15 and 16 will bear on the upper bearing surfaces 25 and 26 and—via spacer lobes 22 (FIG. 2)—on the side wall elements 11, 11*a*, 12 and 12*a*. Sliding guide surfaces 19 of the attachment elements 15 and 16 extend perpendicular to the direction of the height of the side wall elements 11, 11*a*, 12, 12*a* and run in sliding guide slots 20 of a swivel-sliding joint 17, whereby the respective attachment element is retained in directions parallel to the bottom element 13. In addition to the horizontal retention provided by the guide slots 20, guide projections 28, which are preferably provided at end portions of the attachment elements 15 and 16, engage in recesses 27, thus reinforcing the lateral support of the attachment elements 15 and 16 when exposed to loads in parallel to the bottom surface 13. Preferably, the guide projections 28 include shoulders which will simultaneously bear vertically on the side walls 11, 11*a*, 12 and 12*a* or on the upper bearing surfaces 25 and 26.

Figure 2:
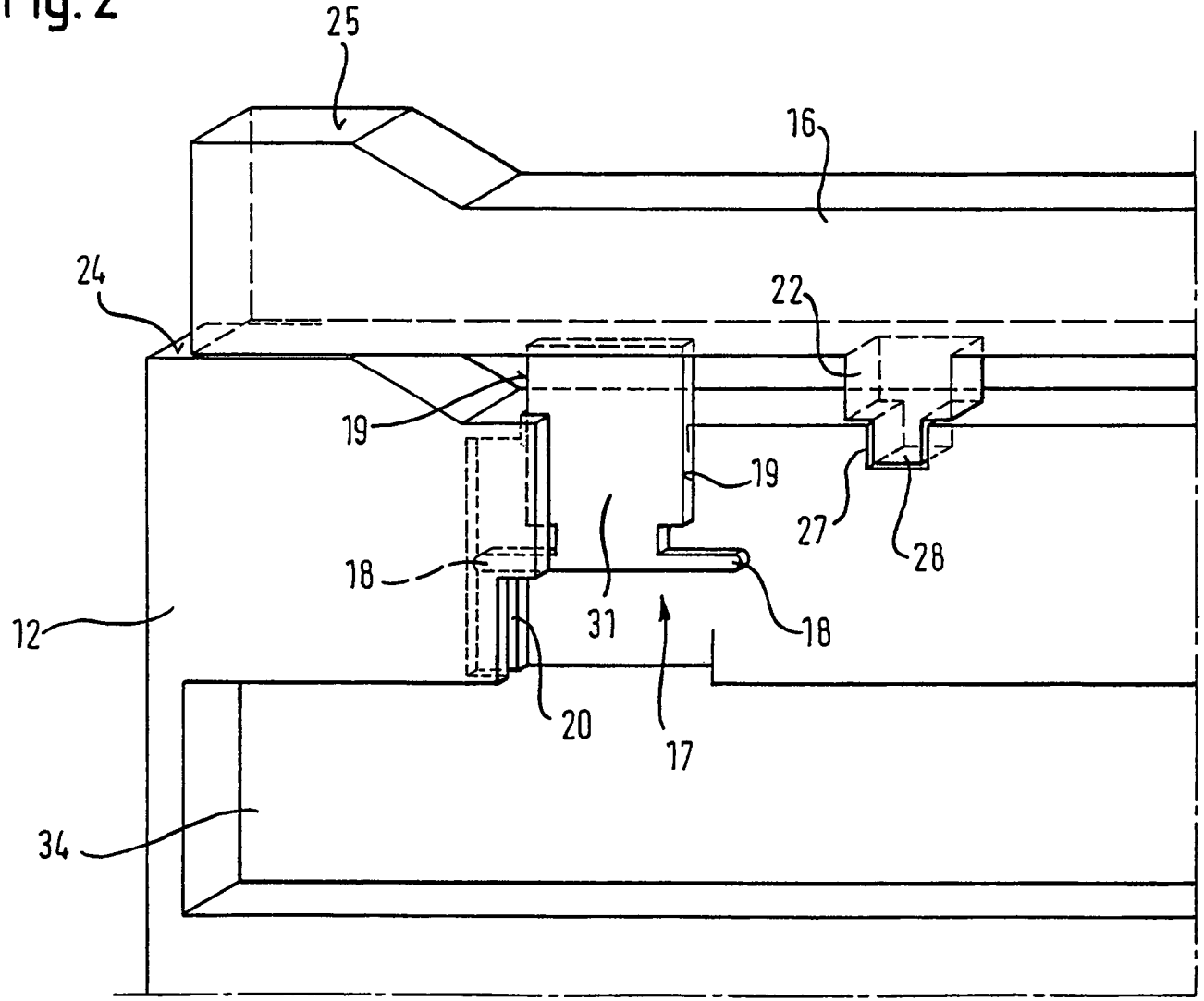
FIG. 2 is an enlarged schematic view of an erecting mechanism for the attachment elements of FIG. 1.

As is further shown in FIGS. 1 and 2, the swivel-sliding joint 17 is located in a recess provided in the side wall elements in such a manner that it will be flush with the side wall element in the direction of its thickness. In this case, the swivel-sliding joint 17 is located such that both in the folded-up and in the folded-down positions of the attachment elements 15 and 16, the joint projections 31 will approximately end up in a position in parallel to the respective side wall elements 11, 11*a*, 12 and 12*a*.

For moving the attachment element 16, as for example shown in FIG. 1, from its upward pivoted position to its folded-down position, the attachment element 16 will first have to be moved away from the bottom element 13 in the direction of the height of the side walls such that the guide projections 28 will move out of their mutual engagement with the recesses 27 and the sliding guide surfaces 19 will move out of the sliding guide slots 20. Once the guides have been released, the attachment element 16 can then be folded down towards the side of the side wall element in which it is to be accommodated. Simultaneously with the 180.degree. swivel movement there has to be a translational movement to ensure that the sliding guide surfaces 19 will not bear on the outer surfaces of the sliding guide slot 20. This translational movement will be in the direction towards the bottom element. With the swivel and sliding movements completed, the attachment element 16 will be accommodated in a receiving space 34 provided in the side wall element 12. In its final position, the attachment element will be substantially flush with the thickness of the side wall element. Just as the attachment element 16 can be integrated into the receiving space 34 of side wall 12, the side wall element 15 shown in FIG. 1 is integrated into the receiving space 33 of side wall 15.

As is shown in FIG. 1, two upper bearing surfaces 23 are provided on side wall 11 where it transitions to the adjacent side walls 12 and 12*a*. Together with the upper bearing surfaces 23*a*, 24 and 24*a* of the other side elements 11*a*, 12 and 12*a*, these bearing surfaces 23 determine the height level of the respective corner areas and thus the transport volume of the crate 10 with the attachment elements folded down. As is likewise shown in FIG. 1, recesses are formed in the corner regions of the bottom element 13 which will accommodate the raised corner portions of the sidewalls or attachment elements when the crates 10 are stacked. This ensures a shift-proof connection of the stacked crates 10.

To also ensure such a shift-proof connection with the attachment elements 15 and 16 folded up, the attachment elements 15 and 16 include upper bearing surfaces 25 and 26. These upper bearing surfaces 25 and 26 on the attachment elements have the same function as the upper bearing surfaces 23, 23*a*, 24 and 24*a* on the side wall elements and will define the increased transport volume of the crate 10 when the attachment elements have been folded up.

FIG. 2 is an enlarged view of a portion of the erected attachment element 16 of FIG. 1 in which only the left end portion of the respective front side of the crate 10 is shown. FIG. 2 shows an exemplary erecting mechanism for the attachment elements 15 and 16 on the basis of the erected attachment element 16. As can be seen from this drawing, in the erected position of the attachment element 16, the sliding guide surfaces 19 provided on either side of the joint projection 31 will engage in sliding guide slots 20, thereby retaining the attachment element 16 horizontally, i.e. parallel to the bottom surface 13, and guiding it vertically. For the sake of clarity, only one sliding guide slot 20 is shown in FIG. 2. A second sliding guide slot 20 (not shown) is located axially symmetrically to the centre line of the joint projection 31 and guides and/or retains the second sliding guide surface 19. Two such sliding guide slots 20 are provided each for every swivel-sliding joint 17.

The attachment element is additionally guided laterally—even if this is not absolutely necessary—through the engagement of guiding projections 28 in recesses 27, both of which are preferably formed so as to support the attachment elements 15 and 16 in the direction in which they are folded down, i.e. their dimensions as viewed in the direction of the thickness of the side walls are smaller than the thickness of the side wall elements.

Figure 3:
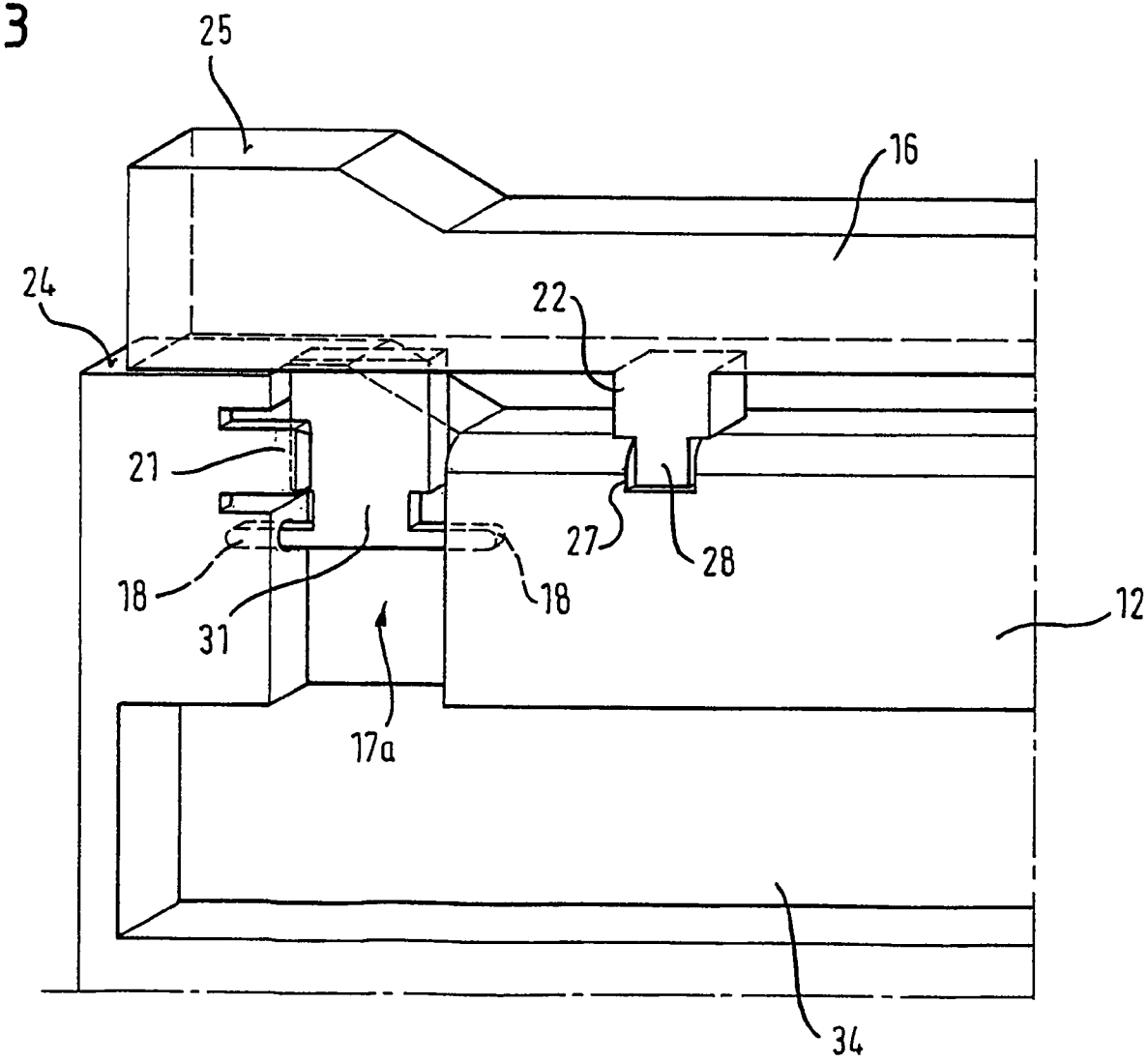
FIG. 3 is a schematic view similar to that of FIG. 2 but with a swivel joint as an erecting mechanism.

The recesses 27 shown in FIGS. 2 and 3 are formed in the side wall elements in such a manner that no slider is necessary for forming or moulding them, e.g. in an injection mould. However, recesses 27 in the form of blind holes are also conceivable, into which the guide projections 28 can be inserted, since—when the attachment elements are folded up or down—the swivel-sliding joint will allow an intermediate position of the attachment elements relative to the side wall elements and vertically spaced therefrom, in which the guide projections 28 will not engage in the recesses 27. However, providing blind holes in the upper terminal surfaces of the side wall elements usually results in higher manufacturing costs for the side wall elements.

In yet another embodiment of the recesses 27 in the side wall elements for which no slider is required, the openings of the recesses 27 do not face in the direction in which the attachment element is folded down as shown in FIGS. 2 and 3, but the openings of the recesses 27 are located such that these openings will eventually be on the opposite side of the receiving spaces 33 and 34 for the attachment elements 15 and 16 provided in the side wall elements 11, 11*a*, 12 and 12*a*, as is exemplarily shown in FIG. 1 for side wall element 12*a*. The guide projection 28 on the attachment element 16 is of corresponding shape so that it will engage in recess 28 when the attachment element has been erected. This especially creates a stop to prevent this element from folding down again, which stop can only be overridden by removing the attachment element from its associated side wall element in the direction of its height. Irrespective of the embodiment, the receiving spaces 27, of which at least one for each side wall element 11, 11*a*, 12 and 12*a* is provided in the side wall elements on the side opposite the receiving spaces 33 and 34, will stabilize the attachment elements in their erected position. Preferably two recesses 27 each are provided on the side of the side wall elements 11, 11*a*, 12 and 12*a* facing away from the receiving spaces 33 and 34, in their end regions. Similarly, corresponding guide projections 28 are provided on the two end regions of the attachment elements 11, 11*a*, 12 and 12*a*.

When the attachment element 16 shown in FIG. 2 is removed from the side wall element 12 in a vertical direction, both the sliding guide surfaces 19 and the guide projections 28 will be moved out of their respective engagement and the attachment element 16 can be swivelled about the pivot pins 18 to the outer side of the transport box 10, as is preferred in this embodiment. As the sliding guide surfaces 19 will rest against the outer sides of the sliding guide slots 20 before an approx. 180° rotation of the attachment element 16 has been completed, there must be a translation of the attachment element 16, which is guided by the pivot pins 18, within the sliding guide slots 20 towards the bottom element 13 with the attachment element swivelled to the outside until the depth of the sliding guide slots 20 recedes and the approx. 180° rotation can be concluded. For this purpose, recesses are provided on the sliding guide surfaces in the transition zone to the pivot pins 18 which will allow such a sliding movement.

Once the sliding movement has been completed, the attachment element 16 can be pivoted into the receiving space 34 in the side wall element 12. Taking the example of the attachment element 15 and the receiving space 33 provided in the side wall element 11, FIG. 1 shows the attachment element 15 in its integrated position in the side wall 11.

In yet another embodiment, the swivel-sliding joints 17 are formed as pure swivel joints 17*a*, with a detent lug 21 retaining the attachment element 16 in the swivelled-up position. One detent lug 21 is provided for each swivel joint 17*a* and mounted on the side wall element, as is exemplarily shown in FIG. 3. Provided on each side of the crate 10 are, at least two swivel joints 17*a* for folding up the attachment elements 15 and 16, as well as a corresponding number of detent lugs.

The embodiment of FIG. 3 shows the detent lugs 21 formed on the side wall 12. However, this is only one example of how the attachment elements can be locked in their folded-up position. Furthermore, all kinds of latching, clamping, bolted, bayonet-type, hook-and-pile type and adhesive connections or the like for temporarily locking the attachment elements in position are conceivable which will fix the attachment elements 15 and 16 in their respective positions in such a manner that they can be readily moved from the folded-up position into the folded-down position and vice versa, with the attachment elements being locked at least in the folded-up position. In this context, it is completely irrelevant whether the male or the female parts of the locking means used are provided on the side walls or on the attachment elements as long as one of the two locking elements is provided on the side wall and the complementary other locking element is provided on the attachment element.

However, the locking means are preferably designed so as not to protrude at all or not substantially over the side wall elements in the direction of their thickness.

Also, the embodiment of the swivel joint which swivels about the swivel pins 18 is only given as one example, and other swivel joints may also be used whose swivelling axis extends in parallel to the bottom surface 13.

In the direction of the height of the side walls, the attachment elements 15 and 16 are supported by spacer lobes 22, as in the previous embodiment, and the number of spacer lobes 22 provided on each side of the crate can be varied.

For improving lateral guidance, i.e. in the direction of the thickness of the side wall element, recesses 27 and guide projections 28 are provided, as already shown in the embodiment of FIGS. 1 and 2. Preferably, the receiving spaces 27 are formed in the side wall elements and the projections 28 are formed on the attachment elements 15 and 16, although they may also be arranged the other way round. Mounted on either the side wall elements or the attachment elements, the guide projections 28 may further be slidable in the direction of the height of the side wall elements so as to be able to be inserted in recesses 27 formed in the respective other element. This may for example be used to lock the attachment elements in position to prevent them from folding down.

For returning the attachment element to its folded-down position when it is not locked in position, only the resistance of the retaining or detent elements 21 needs to be overcome to trigger a return movement in this embodiment. The retaining elements 21 for example take the form of detent lugs 21 which will on the one hand allow and ensure the upright position of the attachment elements 15 and 16 through elastic deformation of their detent bodies and, on the other hand, will release the attachment elements again, for example when a jerking force is imposed, to allow them to be pivoted down into the respective receiving spaces in the associated side walls. In this position, the attachment elements may likewise be immobilized in a suitable way, for example through latching, clamping or interlocking by means of hook-and-pile fasteners etc. to prevent the folded-down attachment elements from being loose or dangling in their respective receiving spaces and being in the way during handling of the crates 10, both in the erected and in the collapsed state of the side wall elements.

Figure 4:
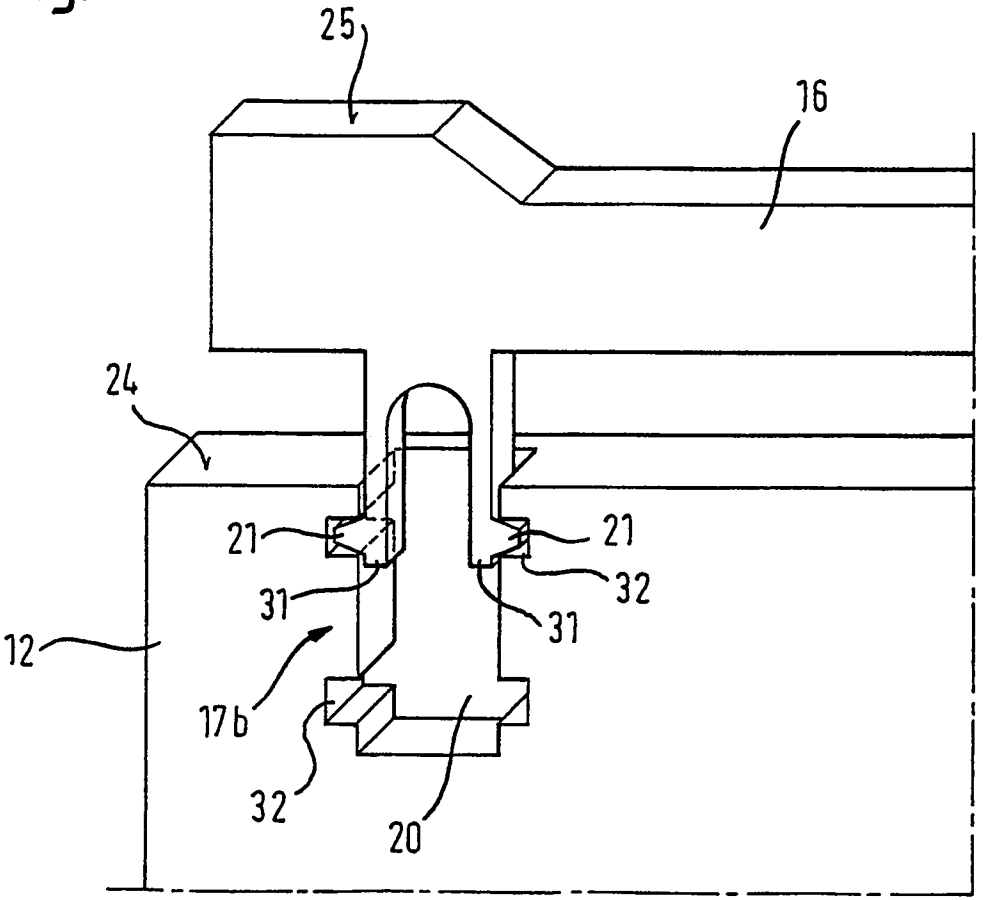
FIG. 4 is a schematic view similar to that of FIG. 2 but with a sliding joint for raising and lowering the attachment elements.

In yet another embodiment shown in FIG. 4, a purely translational movement of the attachment elements 15 and 16 will be required to move them from their integrated position in the side wall elements 11, 11*a*, 12, 12*a* into the position in which they will increase the volumetric capacity of the transport container 10. This may for example be accomplished by a sliding guide 17*b* in which the attachment elements 15 and 16 may be locked at different positions in the sliding guide slots 20, for example by means of detent elements 21 formed on the joint projections 31. Consequently, lowering the attachment elements 15 and 16 again into the position where they are integrated into the side wall elements 11, 11*a*, 12, 12*a* merely requires the detent elements 21 on the guide bars 31 to be disengaged from the recesses 32 in the sliding guide slots 20, and then the attachment elements 15 and 16 can be lowered.

In this embodiment, the upper sides 25 and 26 of the attachment elements 15 and 16, both in their lowered positions and in their raised positions with the side wall elements 11, 11*a*, 12 and 12*a* folded up, serve as support surfaces 25 and 26 for the bottom element 13 of another crate 10 which has been placed atop the present crate 10.

In the integrated position of the attachment elements 15 and 16 in the side wall elements 11, 11*a*, 12, 12*a*, the attachment elements 15 and 16 of the third embodiment as shown in FIG. 4 suitably take over functions of the side wall elements. Consequently, in this position, the upper sides 25 and 26 of the attachment elements 15 and 16 will preferably correspond to the upper sides 23, 23*a*, 24, 24*a* of the side wall elements 11, 11*a*, 12 and 12*a* of the aforementioned embodiments.

An advantage of the embodiment of FIG. 4 is that the attachment elements 15 and 16 can be variably fixed at different height levels through very simple means. The fact that the attachment elements can be located at different height levels is particularly advantageous when the sizes of the bulk goods to be transported in the transport containers 10 vary strongly.

As was explained in the embodiments, attachment elements can be mounted on side wall elements 11, 11*a*, 12, 12*a* in various ways. Embodiments not explicitly listed here shall also be covered by the inventive concept as long as attachment elements which can be varied in position are mounted on a transport container, in particular a crate 10, in such a manner that in their different positions, they will define different transport volumes of the transport container and are undetachably mounted on the transport container. In this case, the support surfaces 23, 23*a*, 24 and 24*a* of the side wall elements 11, 11*a*, 12, 12*a* or the support surfaces 25 and 26 of the attachment elements 15 and 16 will be arranged at an appropriate distance from the bottom element 13 as viewed in the direction of the height of the side walls so as to increase or decrease the volumetric capacity of the transport container.

Both in the erected position of the attachment elements 15 and 16 and in their integrated position in the respective side wall elements 11, 11*a*, 12, 12*a*, quite an effort is required to remove the attachment elements 15 and 16 from the side wall elements.

The invention claimed is:

1. A transport container system for transporting bulk goods, comprising:

a stackable crate having a bottom element and four side wall elements;

wherein each of the four side wall elements includes an attachment element connected to the respective side wall element so as to be movable between a lowered position in the side wall element and a raised position for an increase of a volumetric capacity of the crate, wherein a sliding guide is provided allowing a translational movement of the attachment element between the lowered position and the raised position, wherein an upper side of the attachment element, both in the lowered position and in the raised position, serve as a support surface for a bottom element of a further crate placed atop the crate, wherein the attachment element has a thickness smaller than or equal to the thickness of the side wall element, wherein the sliding guide includes a sliding guide slot in the side wall element and a guide rod extending from an underside of the attachment element into the sliding guide slot, and wherein the guide rod includes locking elements which are arrestable in the sliding guide slot at various positions.

2. The transport container system of claim 1, wherein each of the side wall elements, together with the attachment element, is mounted to the bottom element so as to be folded up from a substantially horizontal position on the bottom element into an upright position at which adjacent side wall elements are interlockable.

3. The transport container system as claimed in claim 1, wherein the crate is configured such that the crate is stackable with the attachment element in the lowered position.

4. The transport container system as claimed in claim 1 wherein the crate is configured such that the crate is stackable with the attachment element in the raised position.

5. The transport container system as claimed in claim 1 wherein the attachment element is detachably mounted on side wall element.

6. The transport container system as claimed in claim 1, wherein the attachment element has a support surface which substantially corresponds in shape to a respective area of an underside of a bottom element of a further crate stacked on the crate so as to interlock with the further crate stacked thereon.

7. The transport container system as claimed in claim 1 wherein the attachment element is made from a same material as the side wall elements.

8. The transport container system as claimed in claim 1 wherein the side wall element and the attachment element are made from different materials.

9. The transport container system of claim 1, wherein the locking elements are arrestable such that in the lowered position of the attachment element, an underside of the attachment element is disposed on an upper side of the side wall element, and such that in the raised position of the attachment element, the underside of the attachment element is disposed at a distance from the upper side of the side wall portion.

* * * * *